US006181906B1

(12) United States Patent
Shiratori

(10) Patent No.: US 6,181,906 B1
(45) Date of Patent: Jan. 30, 2001

(54) IMAGE FORMING APPARATUS HAVING ORIGINAL CONVEYING APPARATUS

(75) Inventor: Tatsuya Shiratori, Kashiwa (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/261,956

(22) Filed: Mar. 3, 1999

(30) Foreign Application Priority Data

Mar. 6, 1998 (JP) ..... 10-055572

(51) Int. Cl.[7] ..... G03G 15/00; B65H 5/22
(52) U.S. Cl. ..... 399/367; 271/4.03; 271/4.08
(58) Field of Search ..... 399/367, 371; 271/3.14, 4.08, 4.09, 4.03

(56) References Cited

U.S. PATENT DOCUMENTS

| | | | | |
|---|---|---|---|---|
| 3,936,041 | * | 2/1976 | Shiino et al. | 241/4.03 |
| 4,787,616 | | 11/1988 | Sasaki et al. | 271/3.1 |
| 4,995,601 | | 2/1991 | Ohashi et al. | 271/127 |
| 5,023,658 | | 6/1991 | Toyama et al. | 355/72 |
| 5,100,123 | | 3/1992 | Kagiura et al. | 271/164 |
| 5,205,551 | | 4/1993 | Nagano et al. | 271/225 |
| 5,347,352 | * | 9/1994 | Morigami et al. | 271/3.01 X |
| 5,442,431 | * | 8/1995 | Fujimoto et al. | 399/367 |
| 5,532,809 | * | 7/1996 | Hamanaka et al. | 399/371 |

* cited by examiner

*Primary Examiner*—Fred L. Braun
(74) *Attorney, Agent, or Firm*—Fitzpatrick, Cella, Harper & Scinto

(57) ABSTRACT

An image forming apparatus has an original conveying apparatus, a scanning device for scanning an original image of the original on the original support glass plate, an image forming portion for forming an image on the basis of the original image read by the scanning device, a recording sheet supply portion for supplying a recording sheet to the image forming portion through a convey path, and a control device for controlling in such a manner that, when the image of each original is formed on N recording sheets, a subsequent original on the original stacking device starts to be supplied during a scanning of the image for a last N-th recording sheet, wherein the N is more than 1.

9 Claims, 4 Drawing Sheets

$$\frac{\Delta R}{S} = \frac{\Delta LOOP + \Delta L}{F} + t$$

FIG. 1A
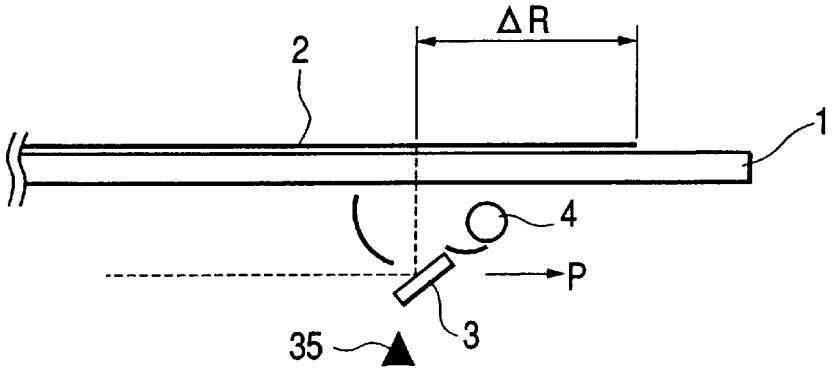
FIG. 1B
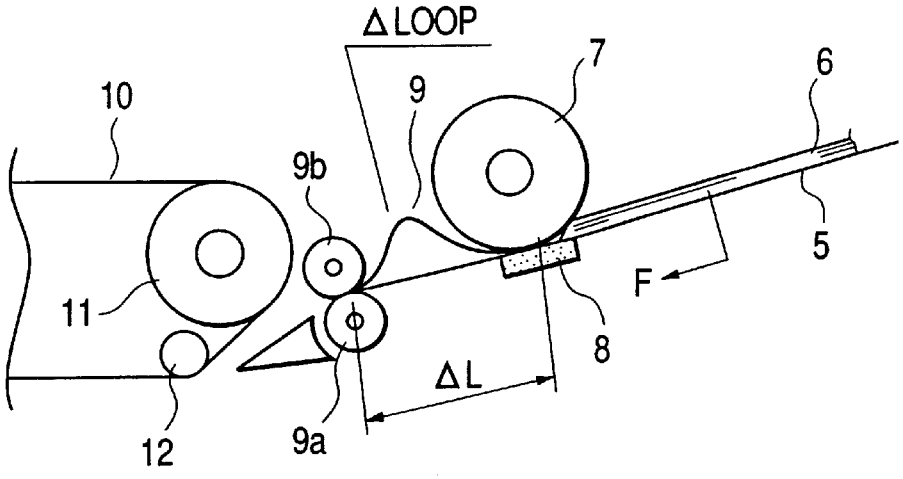
FIG. 1C
$$\frac{\Delta R}{S} = \frac{\Delta LOOP + \Delta L}{F} + t$$

IMAGE FORMING APPARATUS HAVING ORIGINAL CONVEYING APPARATUS

BACKGROUND OF THE INVENTION

1. Field of the Invention

The present invention relates to an image forming apparatus having an original conveying apparatus, and, more particularly, it relates to an image forming apparatus having an original conveying apparatus, in which, for example, if a recording sheet is jammed in a main body of the image forming apparatus, non-processed originals conveyed by the original conveying apparatus can easily be re-set.

2. Related Background Art

In the past, in image forming apparatuses such as electrophotographic copying machines, an auto original conveying apparatus (an auto document feeder (ADF)) capable of automatically separating and conveying originals (documents) and setting the original on an original support glass at a predetermined position thereon has widely been used. Since the original can be set without opening and closing a pressure plate of the image forming apparatus, the ADF is presently inevitable for office copying machines in a view point of efficiency of a copying operation.

First of all, an electrophotographic copying machine as an image forming apparatus to which the present invention is concerned will be described.

FIG. 4 is an elevational sectional view of an electrophotographic copying machine to which the present invention is concerned. An original conveying apparatus 50 capable of automatically supplying a plurality of originals is rested on an original support glass plate 1 of a main body 40 of the copying machine.

In FIG. 4, a sheet bundle 15 rested in a cassette 13 is urged against a sheet supply roller (recording sheet supply portion) 16 by means of an intermediate plate 14, so that an uppermost sheet in the sheet bundle is separated by the sheet supply roller 16 and a separation member and the separated sheet is conveyed to a pair of regist rollers 18, where registration of the sheet 15 in a longitudinal direction is adjusted. The original rested on the original support glass plate 1 in a manner described later is illuminated by an illumination lamp 4, and a read image is incident on a photosensitive drum as an electrophotographic photosensitive body (image forming means) 19 through a mirror 3 and a lens 25, thereby forming an electrostatic latent image. The electrostatic latent image is converted into a toner image by a developing device 21 using toner as developing agent. Positions of the toner image and the recording sheet 15 are in a timed relation obtained by the pair of regist rollers 18, and the toner image is transferred onto the sheet 15 at a proper position thereon by means of a transfer roller (transfer means) 20. After the transferring, the sheet 15 is sent, by a convey means 26, to a fixing device 27, where the toner image is heated and fused to be fixed to the sheet 15. Thereafter, the sheet is discharged onto a sheet discharge tray 33 by a pair of discharge rollers 28.

Next, an operation of the ADF (original conveying apparatus) 50 will be briefly described.

As shown in FIG. 4, the originals are rested on an original tray (original resting means) 5 by the operator. In case of the ADF 50, the originals are successively rested on the original tray 5 with imaged surfaces facing downwardly. The first original is nearest the original tray 5. When a lever 29 of an original presence/absence detection sensor is laid laterally by leading ends (tip ends) of the originals, a photo-interrupter (not shown) is blocked, with the result that an original presence signal is sent to a controller as a control device (control means) 60.

In this condition, when a copy button (not shown) is depressed, an intermediate plate 30 is operated by a drive device (not shown) to contact the leading ends of the originals with a supply roller 7. In this condition, when the supply roller 7 is rotated, an uppermost original in the original stack rested on the intermediate plate (and next and/or other original sheet, in some cases) are conveyed to enter into a nip between a separation pad 8 and the supply roller 7. The original supply roller 7 and the separation pad 8 constitute an original supply means.

In this case, the originals other than the uppermost original are stopped by the separation pad 8, with the result that only one original is conveyed to a pair of registration rollers 9*a*, 9*b*. The pair of registration rollers 9*a*, 9*b* serve to correct skew-feed of the original and to effect registration adjustment. Thereafter, the original is conveyed onto the original support glass plate 1 by an original convey belt 10. When the leading end of the original has passed through a predetermined position on the original support glass plate 1 and reaches an original reverse sensor 31, the original is stopped temporarily, and then is returned by a predetermined amount and then is stopped. This operation is effected, so that, when the original is scanned, the original is correctly positioned on the original support glass plate 1. At this predetermined position, after the original is scanned by an illumination lamp 4 (scan means) such as a halogen lamp mounted on a mirror support (not shown), the original convey belt 10 is operated again to discharge the original onto a discharge tray 32. When a plurality of originals are processed, a subsequent original is supplied while a preceding original is being discharged, and the similar procedures are repeated.

In such an ADF 50, it is assumed that the operator wishes to obtain five sets of copies from three originals by setting the copy number to "5" in an operation portion (not shown).

The operator rests three originals on the original tray 5 of the ADF 50 and depresses a copy start button. As a result, first of all, an uppermost original in the original stack, i.e., a last page (third page) original with imaged surface facing downwardly is urged against the original supply roller 7 by the intermediate plate 30. Then, the original is supplied by the rotation of the original supply roller 7 and then is set at the predetermined position on the original support glass plate 1 by the convey belt 10.

In the present ADF 50, before the optical scanning for the original is started, the subsequent original starts to be supplied, and the subsequent original is waiting while forming a loop therein in front of the pair of registration rollers 9*a*, 9*b*. In this condition, the original on the original support glass plate 1 is scanned. The scanning is effected by five times in total for five recording sheets. After the last fifth scanning is finished, when the illumination lamp 4 (including the first mirror support) starts to be shifted in the opposite direction, the original on the original support glass plate 1 is conveyed toward the discharge tray 32 by the rotation of the convey belt 10. At the same time, the subsequent original having the loop and waited at the pair of registration rollers 9*a*, 9*b* is conveyed by the rotation of the paired registration rollers 9*a*, 9*b* and is reached to the predetermined position on the original support glass plate by the convey belt 10 conveying the preceding original.

The reason for effecting the discharging of the preceding original and the supplying of the subsequent original simultaneously in this way is that the illumination lamp 4 for scanning the original is prevented from being stopped useless at the home position by quickly exchanging the originals. If it takes a long time for exchanging the originals, even when a copying speed of the copying machine (image forming apparatus) 40 is sufficiently high, due to the long exchanging time, the inherent copying speed cannot be utilized completely. It is assumed that the original rested on the original support glass plate 1 is copied continuously. In this case, when the ADF 50 is incorporated into a machine capable of obtaining twelve copies per a minute, if twelve copies can be obtained for each minute, it is said that the copying efficiency is good. However, if an ADF requiring a long original exchanging time is used, the number of copies obtained per minute will be decreased to, for example, ten or nine; this decrease in copying speed is undesirable for the operator.

As mentioned above, after the first original has been supplied, before the first scanning for the original is started, the supplying of the subsequent original and the waiting of the original with the loop at the pair of registration rollers 9*a*, 9*b* have already been completed. During the first scanning for the first image, if the sheet 15 to which the first image is to be transferred is jammed in the vicinity of the fixing device 27, the ADF 50 is operated as follows.

First of all, the original on the original support glass plate 1 is conveyed to the discharge tray. Regardless of the jamming in the copying machine, the operator may open the ADF 50. In such a case, since it is not ensured that the original is positioned at the proper location on the original support glass plate 1, even the original which is not yet copied is once discharged. Further, the subsequent original with the loop waiting at the pair of registration rollers 9*a*, 9*b* should not be retained at that position because the preceding original must be supplied again from the supply opening of the ADF 50 after the jam treatment, and, thus, the subsequent original must also be discharged, similar to the preceding original.

In this way, if the sheet jam occurs in the machine, both the original on the glass plate which is not yet been copied and the subsequent original waiting at the paired registration rollers are discharged. Although the fact that the original which was already copied was discharged can be recognized by the operator, in many cases, the operator cannot easily understand the fact whether the subsequent original which is not yet been copied is also discharged or not, with the result that the operator worriers about how to set the originals again on the original tray 5 of the ADF 50 after the jam treatment of the main body 40.

Thus, the operator must carefully compare the imaged copies discharged on the discharge tray 33 of the main body 40 with the originals discharged on the discharge tray 32 of the ADF 50 to set the originals again. However, when the subsequent original starts to be supplied after the scanning for copying the preceding original is completed and after the preceding original was discharged, since it takes a long time for exchanging the originals as mentioned above, the copying efficiency is considerably decreased.

As is in the prior art, it was found that any merit cannot substantially be obtained by completing the waiting of the subsequent original immediately after the preceding original is set on the original support glass plate 1. As is in the aforementioned example, when five sets of copies are desired, the supplying of the subsequent original may be started at a timing permitting start of conveyance of the subsequent original immediately before the scanning for the fifth copy is completed and when the discharging of the preceding original is started. With this arrangement, even if the sheet 15 is jammed within the main body 40, the subsequent original remains on the original tray 5. Accordingly, since only the original once set on the original support glass plate 1 is discharged, the operator can easily recognize the discharged original. Thus, after the jam treatment, the original can easily be re-set.

SUMMARY OF THE INVENTION

An object of the present invention is to provide an image forming apparatus having an original conveying apparatus, and more particularly, an image forming apparatus having an original conveying apparatus, in which, for example, if sheet jam occurs within the main body of the apparatus, stay of an original in the original conveying apparatus can be reduced.

The present invention provides an image forming apparatus comprising an original conveying apparatus including an original stacking means for stacking a plurality of originals, an original supply means for separating and supplying the originals one by one from the original stacking means, a pair of registration rollers for adjusting a leading end position of the original fed by the supply means, a convey means for conveying the original conveyed by the pair of registration rollers to a predetermined location on an original support glass plate, and a discharge tray on which the originals scanned on the original support glass plate are stacked; a scanning means for scanning an original image of the original on the original support glass plate; an image forming portion for forming an image on the basis of the original image read by the scanning means; a recording sheet supply portion for supplying a recording sheet to the image forming portion through a convey path; and a control means for controlling in such a manner that, when the image of each original is formed on N (number) recording sheets, during the scanning for the image of the last N-th original, a subsequent original on the original stacking means starts to be supplied.

Further, in the scanning of the image of the last original, when it is assumed that a non-scanned portion of the original is ΔR (mm), a scanning speed of the scanning means is S (mm/sec), a distance between the original supply means and the pair of registration rollers is ΔL (mm), an amount of a loop in the original formed between the original supply means and the pair of registration rollers is ΔLoop (mm), an original supplying speed is F (mm/sec) and a margin time for the original conveying operation is t (s), a timing for supplying the subsequent original effected by the original supply means may be a time when the scanning means is positioned at a position where the non-scanned portion ΔR (mm) of the original becomes as follows:

$$\Delta R = S[(\Delta Loop + \Delta L)/F + t]$$

Further, a scan detection means for detecting the scanning means may be provided at a position where the scanning means reaches the non-scanned portion ΔR.

Further, the recording sheet supply portion may comprise a sheet supply area including sheet supply means for supplying the recording sheet, and a separation member for separating the sheets, and the timing for supplying the subsequent original effected by the original supply means may be a time after the last N-th recording sheet among the recording sheets on which the image of the preceding original are to be formed leaves the sheet supply area.

Further, a sheet pass detection sensor for detecting the recording sheet being conveyed may be provided in the convey path on the way thereof, and the timing for supplying the subsequent original effected by the original supply means may be a time after the last N-th recording sheet among the recording sheets on which the image of the preceding original are to be formed leaves the sheet pass detection sensor.

Further, when it is assumed that a length of a non-scanned portion of the N-th original is ΔR (mm) and a length of a non-recorded portion of the image which is not yet recorded on the recording sheet in the image forming portion among the images which were already scanned by the scanning means is ΔD (mm), a timing for supplying the subsequent original effected by the original stacking means may be a time when a trailing end of the sheet reaches a predetermined position slightly upstream a position spaced apart from a recording sheet recording position of the image forming portion upstream by a distance (ΔD+ΔR).

With the arrangement as mentioned above, when N (number) copies of for each original are obtained by N (number) scans regarding a plurality of originals, during the last N-th scanning among plural of scans for one original, the supplying of the subsequent original is started by the original supply means. Thus, the original supplied and stayed when the recording sheet on which the image is to be formed by the original scanning is jammed in the main body of the apparatus is the original set on the original support glass plate, for almost all cases, and, accordingly, the operator can easily select the non-processed (non-scanned) original on the discharge tray, with the result that the non-processed originals can easily be re-set on the supply tray after the jam treatment.

Further, a supplying timing for the subsequent original is selected to a time after the last N-th recording sheet leaves the sheet supply area. Further, after the scanning of the preceding original is completed, the preceding original is discharged and the subsequent original is supplied. Thus, if the recording sheet is jammed, only one original can be remained on the original support glass plate. Accordingly, the non-processed original can easily be discriminated.

As described above, according to the invention, when a plurality of originals are used and a plurality of scans are performed for each original to record an image on a plurality of recording sheets, during a last N-th scan among N times of scan for a single original, a supply of a subsequent original is started. Therefore, if a recording sheet is jammed in a main body of the apparatus, the invention makes it greater a possibility to keep a number of the originals supplied and stayed in the original conveying apparatus below one. Thus, the operator can easily select a non-processed original among the originals on the discharge tray of the original conveying apparatus so that the non-processed original can be very easily re-set on the original stacking means after the jam treatment.

BRIEF DESCRIPTION OF THE DRAWINGS

FIG. 1A is a view showing an original scanning condition in an original conveying apparatus according to a first embodiment of the present invention, FIG. 1B is an elevational sectional view showing main parts of the original conveying apparatus, FIG. 1C is a view showing a calculation equation for calculating a supplying timing for a subsequent original;

DESCRIPTION OF THE PREFERRED EMBODIMENTS

Figure 2:
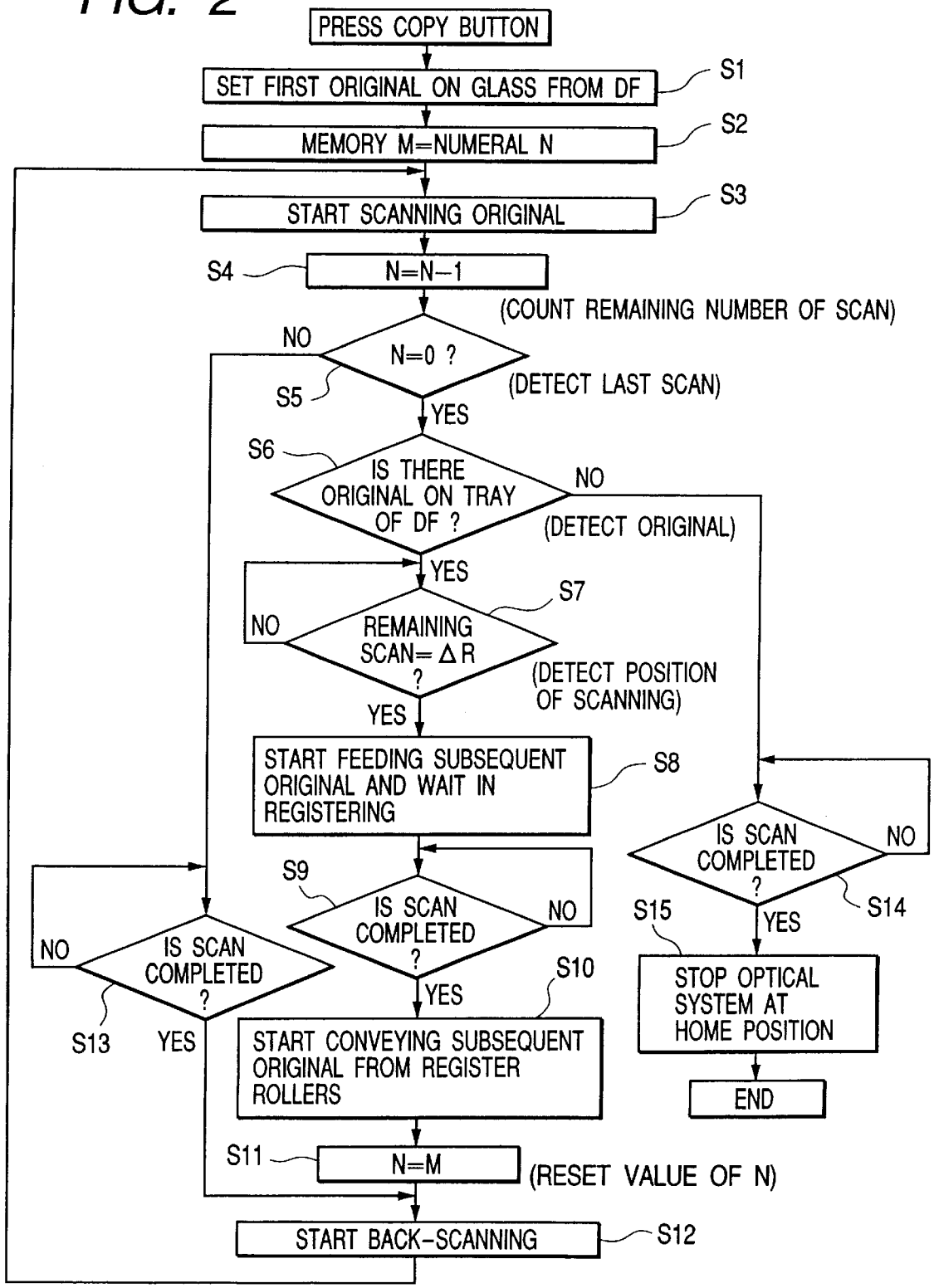
FIG. 2 is a flow chart showing an operation of the original conveying apparatus.

The present invention will now be explained in connection with embodiments thereof with reference to the accompanying drawings.

<First Embodiment>

FIG. 1A shows a first mirror 3 and an illumination lamp 4 which serve to scan an original 2 rested on an original support glass plate 1 and, more particularly, shows a condition that a first mirror support (not shown) supporting the first mirror 3 and the illumination lamp 4 is shifted in a direction shown by the arrow P to scan the original 2 until a non-scanned portion of the original 2 becomes ΔR (mm). In this case, it is assumed that the illumination lamp 4 moves at a speed of S (mm/sec). The scanning of the illumination lamp 4 is effected by an optical system when the operator who wishes N (number) parts of copies sets the numeral N in an operation portion. The condition shown in FIG. 1A is a last (N-th) scanning condition of the illumination lamp 4 among N (number) scans.

FIG. 1B is an elevational sectional view showing main parts of a sheet supply portion of an ADF 50.

An original bundle 6 comprised of a plurality of originals 2 is rested on an original tray 5. A single original 2 is separated and conveyed from the original bundle 6 by a supply roller 7 and a separation pad 8. A pair of registration rollers 9*a*, 9*b* are disposed at a position spaced apart from a nip between the supply roller 7 and the separation pad 8 by a distance of ΔL (mm). A convey belt 10, a belt pulley 11 for driving the convey belt 10, and a deflection shaft 12 are disposed at a downstream side of the pair of registration rollers 9*a*, 9*b*. In this condition, it is assumed that the original 2 on the original tray 5 is conveyed by rotation of the supply roller (original supply means) 7 at a conveying speed of F (mm/sec). In this case, it is also assumed that a loop 9 having an amount of ΔLoop (mm) is formed in the original 2 at the registration portion having the distance ΔL (mm). A time from when the supply roller 7 of the ADF 50 starts to rotate to when the loop 9 is completed is defined as follows:

$$\text{Loop forming time}=(\Delta Loop+\Delta L)/F$$

FIG. 1C shows a calculation equation showing a supplying timing for a subsequent original 2.

In FIG. 1A, ΔR (mm) is a length of a non-scanned portion of the original 2. This is a critical point that, if the non-scanned portion is decreased below ΔR, the supplying of the subsequent original and the waiting of the subsequent original at the registration portion cannot be completed during the scanning of the preceding original.

In the condition that the non-scanned portion has the length ΔR as shown in FIG. 1A, when the supplying of the subsequent original is started, the following requirement must be satisfied:

$$\Delta R/S=(\Delta Loop+\Delta L)/F+t \quad (1)$$

Where, ΔR/S is a time period (s) during which the scan remaining length ΔR (mm) is scanned by the illumination lamp 4, and t is a margin time (s) for operation. At a time when the scanning is effected up to a position of ΔR (mm) satisfying the above equation (1), when the subsequent original 2 is supplied, before the scanning of the illumination lamp 4 shown in FIG. 1A is finished, the waiting of the subsequent original 2 with the loop 9 formed in the registration portion (9*a*, 9*b*) is completed without fail. Of course, when the scanning of the illumination lamp 4 is (N−1)-th or before, even if the illumination lamp 4 reaches the position of ΔR (mm), the supplying of the subsequent original 2 in the ADF 50 is not started, but the original 2 is held on the original tray 5. Thus, during almost all of the scanning of the preceding original 2, the subsequent original 2 remains on the original tray 5, with the result that, if the recording sheet 15 is jammed in the apparatus 40, only the original 2 on the original support glass plate 1 is discharged onto the discharge tray 32 of the ADF 50.

FIG. 2 is a flow chart showing an operation of the original conveying apparatus according to the present invention.

In this flow chart, the originals 2 are conveyed by using the ADF 50 and the operator manipulates the operation portion to obtain N (number) parts of copies. In this condition, when the copy button is depressed by the operator, first of all, the first original 2 is supplied by the supply roller of the DF (step S1), and, after the skew-feed of the original is corrected by the pair of registration rollers 9*a*, 9*b*, the original is set at the predetermined position on the original support glass plate 1. In this condition, a value of numeral N is temporarily stored in a memory M (step S2). The value N is decreased when the remaining number of copies is decreased by the copying operation.

When the original 2 is set on the original support glass plate 1, the optical system including the illumination lamp 4 starts to be operated (step S3). Thereafter, the number of scans which should be carried out after the scanning being presently performed is calculated in the controller. This means N=N−1 (step S4). Then, it is discriminated whether the value N is zero (0) or not. This is discrimination whether there is the remaining number of scans regarding the original 2 presently rested on the glass plate or not; if N=0, it means that the remaining number of scans is absent (zero) (step S5).

If the predetermined number of copies are not yet obtained, the program goes to "NO", and, after the scanning being presently performed is completed, the optical system starts back-scanning (step S12), thereby continuing re-scanning. If there is no remaining number of scans, it is checked whether there is the original 2 which is not yet scanned on the original tray 5 of the ADF or not (step S6). If there is no original 2, it is regarded that the series of operations are finished, and, after the present scanning is finished, the optical system is returned to the home position and stopped there and the operation of the apparatus is also stopped (steps S14 and S15).

When the scanning of the original 2 presently rested on the original support glass plate 1 is the last scanning and there is the subsequent original 2 on the original tray 5 of the ADF 50, the sequence of the operation of the original conveying apparatus according to the present invention is started.

An illumination lamp sensor (scan detection means) 35 always checks whether the position of the advancing illumination lamp 4 of the optical system is the above-mentioned position ΔR as the remaining distance of the original 2 to be scanned (step S7). When this position is reached, the supplying of the subsequent original 2 is started, and the loop for skew-feed correction is formed in the subsequent original 2 at the pair of registration rollers 9*a*, 9*b* and then the subsequent original is waiting in the registration portion (step S8). Thereafter, when the illumination lamp 4 finishes the scanning of the original 2, the convey belt is operated (step S9), so that the subsequent original 2 is conveyed from the pair of registration rollers 9*a*, 9*b* onto the original support glass plate 1 (step S10). In this way, the discharging of the preceding original 2 and the conveyance of the subsequent original 2 are effected simultaneously, thereby finishing the exchanging of the originals 2. The memory M storing the remaining number of copies is reset to the value (value stored in the memory M) set by the operator in the operation portion as the desired number to be copied (step Sll). The exchanged subsequent original 2 follows the same flow. In this way, the copies are completed successively.

<Second Embodiment>

Next, a second embodiment of the present invention will be explained.

In the first embodiment, an example that the waiting of the subsequent original 2 is completed without fail during the scanning of the preceding original 2 was explained. This second embodiment is devised on the basis of the fact that the chance of occurring the sheet jam in the supply portion is greatest among the possible sheet jams within the apparatus 40.

Figure 3:
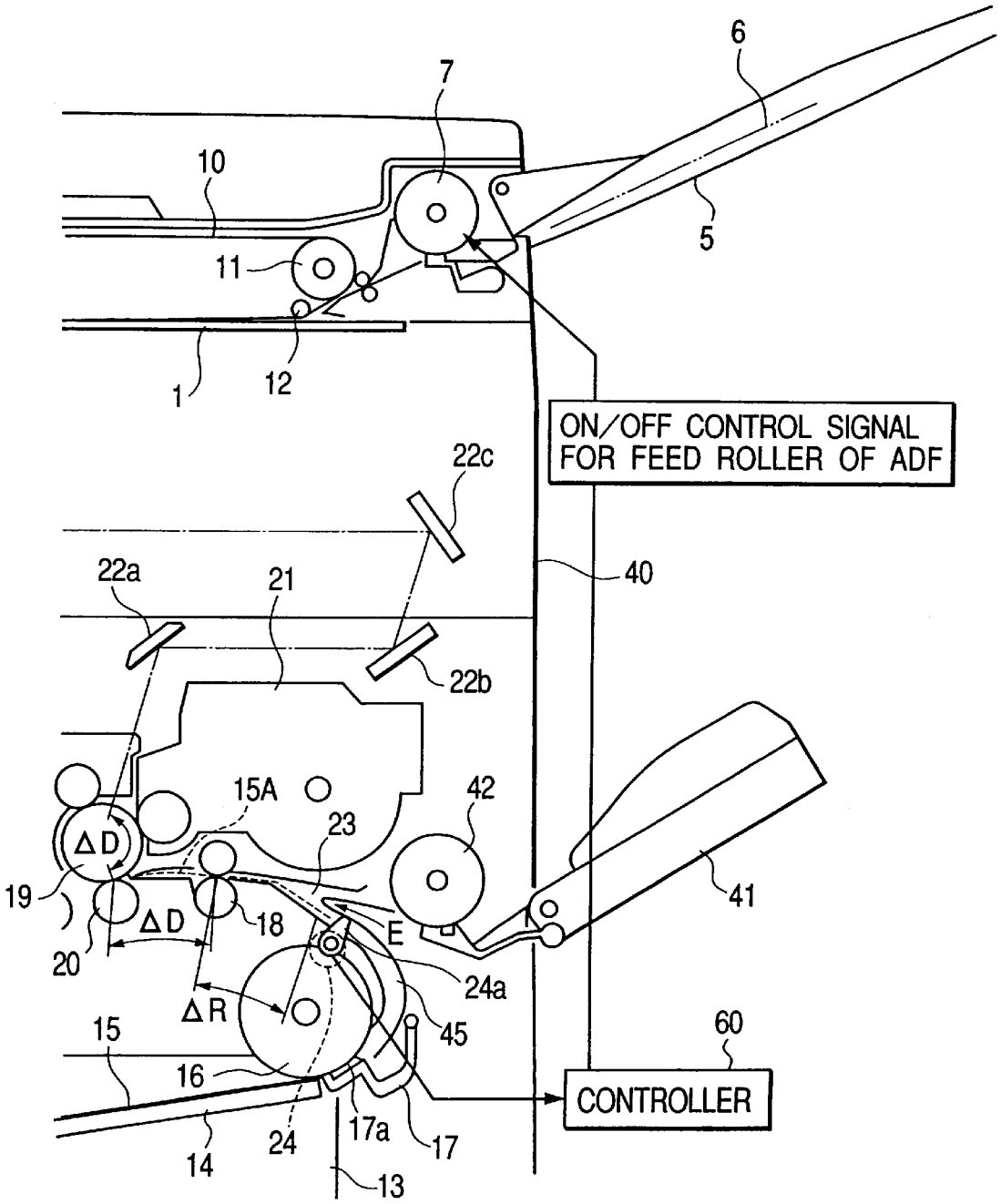
FIG. 3 is an elevational sectional view showing an original conveying apparatus and an image forming apparatus according to a second embodiment of the present invention.

FIG. 3 is an elevational sectional view showing sheet supply portions of the image forming apparatus and of the ADF 50.

Figure 4:
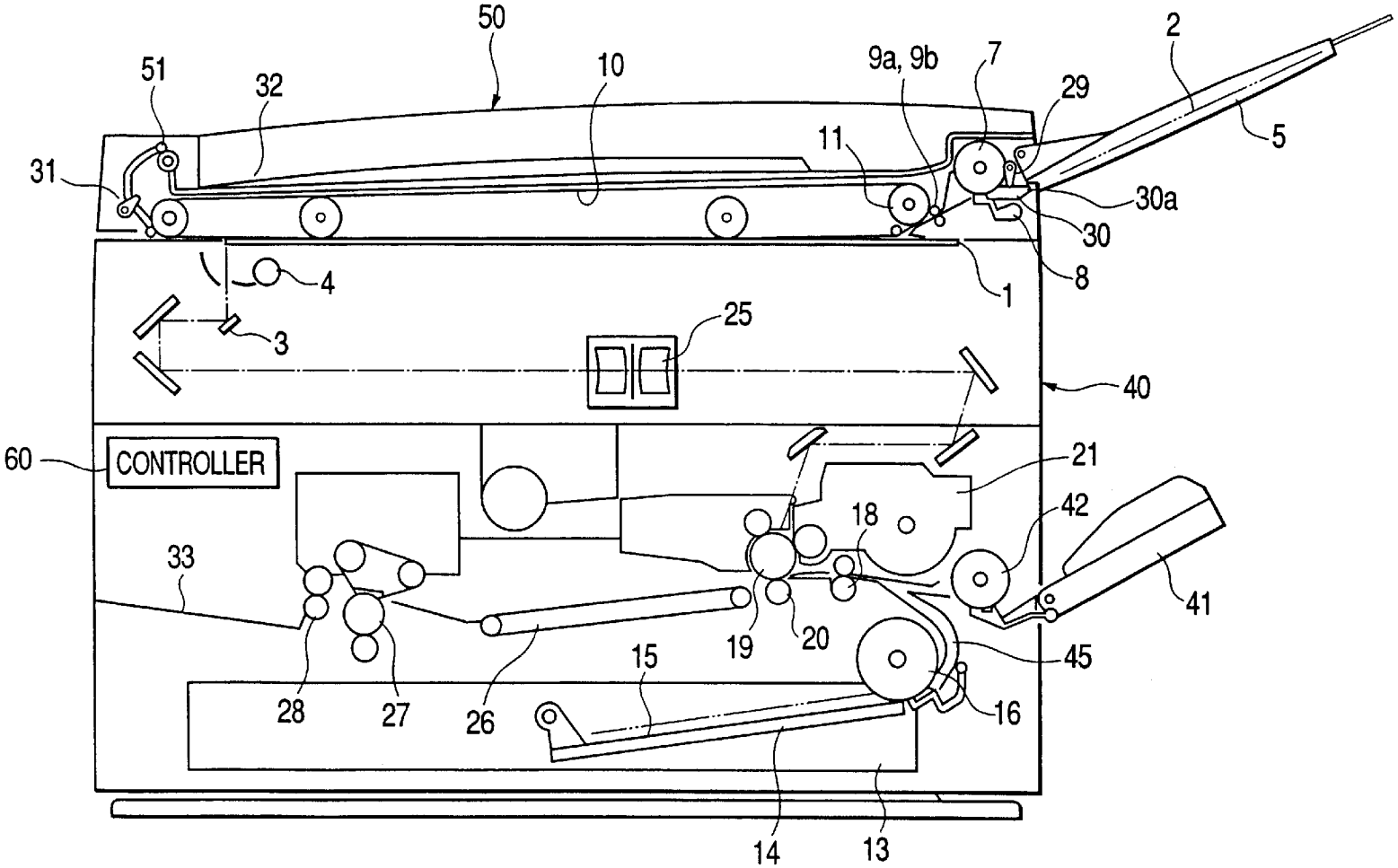
FIG. 4 is an elevational sectional view of an image forming apparatus having an original conveying apparatus to which the present invention is concerned.

The reference numeral 6 denotes an original bundle rested on the sheet supply tray 5. As shown in FIG. 4, a cassette 13 of the apparatus is provided with an intermediate plate 14 on which a sheet bundle comprised of a plurality of recording sheets 15 is rested. The recording sheets 15 are separated one by one by a sheet supply roller 16 and a separation pad, and the separated recording sheet is conveyed to a pair of downstream registration rollers 18. Light beam of an image shown by the dot and dash line is illuminated onto a photosensitive drum 19 through a group of mirrors 22*a*, 22*b*, 22*c* and is converted into a toner image by a developing device 21.

In this case, the broken line 15A (FIG. 3) indicates a position of the sheet 15 in a convey path 23 when the illumination lamp 4 is situated in a condition shown in FIG. 1A. A peripheral length of the photosensitive drum 19 from an image illuminating position on the photosensitive drum 19 to a contact position between the photosensitive drum 19 and a transfer roller 20 is ΔD (mm), and a trailing end of the sheet is located at a position speed apart from the contact point of the transfer roller 20 by a sheet convey distance (ΔR+ΔD).

The value ΔD is a length of an area where the optical scanning of the illumination lamp 4 is completed but the toner image is not yet transferred to the recording sheet 15. When the trailing end of the recording sheet 15 is located at an upstream side of a position spaced apart from the transferring point on the photosensitive drum 19 upstreamly by the distance (ΔR+ΔD), the subsequent original 2 is supplied.

As is in the previous embodiment, this is a critical condition that the ADF 50 starts the sheet supply. Thus, at the early point, so long as the trailing end of the sheet 15 passes through a nip between the sheet supply roller 16 and the separation pad (separation member) 17*a* of a separation arm 17, if the sheet 15 is jammed, only one original is discharged in the ADF 50.

The nip between the sheet supply roller 16 and the separation member 17*a* is referred to as a sheet supply area. As mentioned above, the sheet supplying timing of the supply roller 7 of the ADF 50 is a time after the trailing end of the sheet 15 leaves the sheet supply area.

A sensor lever 24*a* is disposed at a downstream side of the sheet supply area and at an upstream position spaced apart from the transfer point on the photosensitive drum 19 by a distance (ΔD+ΔR). The lever 24*a* is a sensor lever of a sheet pass detection sensor 24 and is laid laterally in the direction shown by the arrow E by the passage of the sheet 15, with the result that the passage of the sheet is detected by a photo-interrupter (not shown). A signal from the photo-interrupter is transmitted to a controller 60 which in turn controls ON/OFF of the supply roller 7 of the ADF 50. Thus, at a time when the passage of the trailing end of the sheet 15 is detected by the sensor lever 24*a* having the position as shown, i.e., at a time when the signal from the sheet pass detection sensor 24 is changed from ON to OFF, when the supplying of the subsequent original 2 in the ADF 50, (1) the waiting of the subsequent original 2 is completed during the last scanning of the preceding original 2; and (2) after the trailing end of the sheet leaves the sheet supply portion (sheet supply roller 16 portion) where the sheet is most apt to be jammed, the supplying of the subsequent original 2 can be started in the ADF 50; and, if the sheet 15 is jammed in the apparatus 40, the subsequent original can remain on the sheet supply tray 5.

Thus, after the jam treatment of the sheet 15 in the apparatus, the operator can easily re-set the originals 2 in the ADF 50. However, if the sheet 15 to be used regarding the last scanning of the original 2 is jammed in the fixing device 27 or a downstream location, since the supplying of the subsequent original has already been started, two originals 2 will be discharged in the ADF 50. However, in any cases, since the original has passed through the sheet supply portion where the sheet is most apt to be jammed, the sheet jam is hard to occur, and, thus, in comparison with the conventional techniques, greater merit can be obtained particularly when the large number of parts of copies are processed.

What is claimed is:

1. An image forming apparatus comprising:

an original conveying apparatus including an original stacking means for stacking a plurality of originals, an original supply means for separating and supplying the originals one by one from said original stacking means, a pair of registration rollers for adjusting a leading end position of the original fed by said supply means, a convey means for conveying the original conveyed by said pair of registration rollers to a predetermined location on an original support glass plate, and a discharge tray on which the originals scanned on said original support glass plate are stacked;

scanning means for scanning an original image of the original on said original support glass plate;

an image forming portion for forming an image on the basis of the original image read by said scanning means;

a recording sheet supply portion for supplying a recording sheet to said image forming portion through a convey path; and control means for controlling in such a manner that, when the image of each original is formed on N recording sheets, a subsequent original on said original stacking means starts to be supplied during a scanning of the image for a last N-th recording sheet, wherein the N is more than 1.

2. An image forming apparatus according to claim 1, wherein, in the scanning of the image of the last original, a non-scanned portion of the original is ΔR, a scanning speed of said scanning means is S, a distance between said original supply means and said pair of registration rollers is ΔL, an amount of a loop in the original formed between said original supply means and said pair of registration rollers is ΔLoop, an original supplying speed is F and a margin time for the original conveying operation is t, and wherein a timing for supplying the subsequent original effected by said original supply means is a time when said scanning means is positioned at a position where the non-scanned portion ΔR of the original becomes as follows:

$$\Delta R = S[(\Delta Loop + \Delta L)/F + t].$$

3. An image forming apparatus according to claim 2, further comprising a scan detection means for detecting said scanning means, said scan detection means being provided at a position where said scanning means reaches the non-scanned portion ΔR.

4. An image forming apparatus according to claim 1, wherein said recording sheet supply portion comprises a sheet supply area including a sheet supply means for supplying the recording sheet and a separation member for separating the sheets, and a timing for supplying the subsequent original effected by said original supply means is a time after the last N-th recording sheet among the recording sheets on which the image of the preceding original are to be formed leaves said sheet supply area.

5. An image forming apparatus according to claim 4, wherein said sheet supply means comprises a sheet supply roller and said separation member comprises a friction pad, and said sheet supply area is constituted by a nip between said sheet supply roller and said friction pad.

6. An image forming apparatus according to claim 1, wherein a length of a non-scanned portion of the N-th original is ΔR and a length of a non-recorded portion of the image which is not yet recorded on the recording sheet in said image forming portion among the images which were already scanned by said scanning means is ΔD, and wherein a timing for supplying the subsequent original effected by said original stacking means is a time when a trailing end of the recording sheet reaches a predetermined position slightly upstream a position spaced apart from a recording sheet recording position of said image forming portion upstreamly by a distance (ΔD+ΔR).

7. An image forming apparatus according to claim 6, further comprising a sensor disposed at a position at an upstream side of the position (ΔD+ΔR) so that, when a trailing end of the sheet leaves said sensor, an original supplying signal is emitted.

8. An image forming apparatus according to claim 1, further comprising a sheet pass detection sensor for detecting the recording sheet being conveyed, said sheet pass detection sensor being provided in said convey path on the way thereof, and the timing for supplying the subsequent original effected by said original supply means is a time immediately after the last N-th recording sheet among the recording sheets on which the image of the preceding original are to be formed leaves said sheet pass detection sensor.

9. An image forming apparatus according to claim 1, wherein said recording sheet supply portion comprises a sheet supply area including a sheet supply means for supplying the recording sheet and a separation member for separating the sheets, and a timing for supplying the subsequent original effected by said original supply means is a time after the last N-th recording sheet among the recording sheets on which the image of the preceding original are to be formed leaves said sheet supply area, and before a trailing end of the recording sheet reaches a position of (ΔD+ΔR) distant, from a recording sheet recording position of said image forming portion, and wherein a length of a non-scanned portion of the N-th original is ΔR and a length of a non-recorded portion of the image which is not yet recorded on the recording sheet in said image forming portion among the images which were already scanned by said scanning means is ΔD.

* * * * *

UNITED STATES PATENT AND TRADEMARK OFFICE

CERTIFICATE OF CORRECTION

PATENT NO. : 6,181,906 B1
DATED : January 30, 2001
INVENTOR(S) : Tatsuya Shiratori It is certified that error appears in the above-identified patent and that said Letters Patent is hereby corrected as shown below:

Title page,
Item [54], Title: "IMAGE FORMING APPARATUS HAVING ORIGINAL CONVEYING APPARATUS" should read -- IMAGE FORMING APPARATUS HAVING CONTROL OF FEED OF SUBSEQUENT ORIGINAL --.
Item [56], RC: U.S. Patent Documents: "Shiino et al." should read -- Shiina et al. --.

Sheet No. 2,
Figure 2, "SCAN)" should read -- SCANS) --.

Column 1:
Line 2, "ORIGINAL CONVEYING APPARATUS" should read -- CONTROL OF FEED OF SUBSEQUENT ORIGINAL --.
Line 23, "in" should read -- from --.
Lines 39 and 50, "regist" should read -- register --.

Column 2,
Line 61, "is reached to" should read -- reaches --.

Column 3,
Line 2, "less" should read -- lessly --.
Line 10, "a" should be deleted.
Line 31, "once" should read -- at once --.
Line 44, "is" should read -- has --.
Line 46, "worriers" should read -- worries --.

Column 5,
Line 4, "are" should read -- is --.
Line 18, "of" should be deleted.
Line 36, "be" should be deleted.
Line 37, "remained" should read -- remain --.
Line 46, "greater a" should read -- a greater --.
Line 47, "stayed" should read -- maintained --.

UNITED STATES PATENT AND TRADEMARK OFFICE

CERTIFICATE OF CORRECTION

PATENT NO. : 6,181,906 B1
DATED : January 30, 2001
INVENTOR(S) : Tatsuya Shiratori It is certified that error appears in the above-identified patent and that said Letters Patent is hereby corrected as shown below:

Column 8,
Line 19, "occurring the sheet jam" should read -- the sheet jam occurring --.

Column 9,
Line 26, "cases," should read -- case, --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*